United States Patent [19]

Belanger

[11] Patent Number: 4,700,420

[45] Date of Patent: Oct. 20, 1987

[54] MULTI-PURPOSE CAMPING TOOL

[76] Inventor: John Belanger, 205 Well St., Crown Point, Ind. 46307

[21] Appl. No.: 710,562

[22] Filed: Mar. 11, 1985

Related U.S. Application Data

[63] Continuation-in-part of Ser. No. 565,405, Dec. 27, 1983, abandoned.

[51] Int. Cl.[4] ..... B25F 1/02

[52] U.S. Cl. ..... 7/114; 7/167; 403/342; 403/343; 182/91; 182/100

[58] Field of Search ..... 7/114, 115, 116, 167, 7/170; 403/342, 343, 354, 299, 361, 246; 182/189, 91, 100

[56] References Cited

U.S. PATENT DOCUMENTS

| | | | |
|---|---|---|---|
| 190,112 | 5/1877 | Allen | 182/189 |
| 576,756 | 2/1897 | Cole | 7/116 |
| 993,015 | 5/1911 | Bengtsson . | |
| 1,191,405 | 7/1916 | Daubenspeck . | |
| 1,542,652 | 6/1925 | Anderson . | |
| 2,047,704 | 7/1936 | Podolsky | 403/354 |
| 2,086,422 | 7/1937 | Klimt | 403/342 |
| 2,102,133 | 12/1937 | Schoenberger . | |
| 2,497,384 | 2/1950 | Young | 403/343 |
| 3,401,971 | 9/1968 | Cronquist . | |
| 3,490,078 | 1/1970 | Perez, Jr. | 403/343 |
| 3,592,272 | 7/1971 | Perez . | |
| 4,432,436 | 2/1984 | Suiter | 182/100 |

FOREIGN PATENT DOCUMENTS

| | | | |
|---|---|---|---|
| 651385 | 10/1937 | Fed. Rep. of Germany | 403/342 |
| 1197329 | 6/1959 | France | 403/343 |
| 701195 | 12/1953 | United Kingdom | 403/342 |

*Primary Examiner*—Roscoe V. Parker

*Attorney, Agent, or Firm*—Richard G. Kinney

[57] ABSTRACT

A multi-purpose camping tool having components which are structured to be combined together to form a pole ladder, an ax, a trenching spade, a hoe, a grapple hook, tool devices and a saw frame. The components include a spade blade, tool heads, handle connecting elements, and a pair of elongated segments having a novel structure and parts which cooperate to provide these several multi-purpose tools.

20 Claims, 23 Drawing Figures

MULTI-PURPOSE CAMPING TOOL

CROSS-REFERENCE

This application is a continuation-in-part of Ser. No. 06/565,405 filed Dec. 27, 1983 by applicant that application is now abandoned.

BACKGROUND OF THE INVENTION

1. Field of the Invention

This invention relates to a camping tools and more particularly to a multi-purpose camping tool.

2. Description of the Prior Art

Prior art camping tool that I am aware of that may be converted to a tool for multiple uses are trenching tools such as disclosed in U.S. Pat. Nos. 993,015 and 3,401,971; the former discloses a trenching spade or shovel-handle combination which may be converted to serve as a tent pole, a support for a rifle and a framework for a military protective cover among other uses and the latter discloses a trenching spade-handle combination which may be easily compacted for portability. Also the spade blade is structured to include a serrated side for cutting purposes among other described advantages. None of these patents, or any trenching tool of the prior art that I am aware of, disclose a trenching tool-handle combination which may be converted to serve as a pole ladder, an ax, wire cutters and a saw among other uses nor does the prior art disclose a connecting coupling for a handle to connect a variety of tool devices. Such activities as chopping, wire cutting, sawing and climbing are extremely important for military and general camping purposes.

SUMMARY OF THE INVENTION

My invention comprises a novel spade and handle which can be combined to provide novel capability for conversion to an ax, a saw, wire cutters, hammer, pick, nail puller, and a ladder among other uses. As described in greater detail in the description which follows, the blade of the spade is formed with a sharpened side protuberance providing the ax blade; the connecting means on the handle forming the means for connecting to the spade blade also forms the connecting means for constructing a pole ladder, wire cutters and a variety of other tool devices.

These as well as other objects and advantages will become apparent upon a careful study of the following detailed description of this invention when read with reference to the accompanying drawings which illustrate a preferred embodiment of this invention.

DETAILED DESCRIPTION OF THE INVENTION

Figure 7:
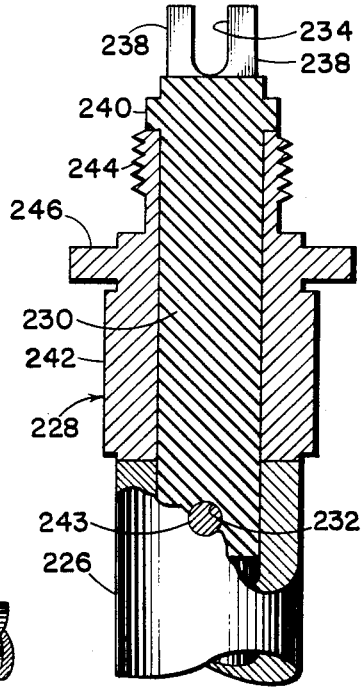
FIG. 7 is a longitudinal section of the male member of the connecting coupling.
Figure 10:
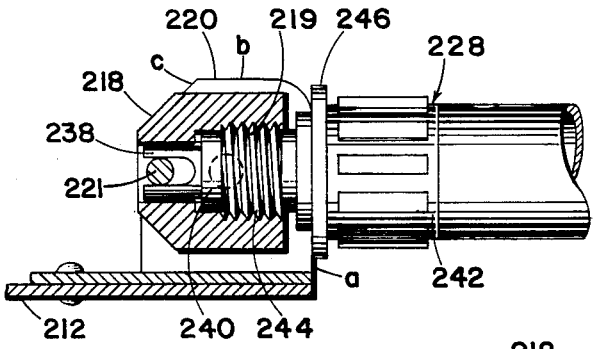
FIGS. 10*a*, 10*b* and 10*c* are longitudinal section views showing in detail the connection between the handle member and modified pivot connector of the spade blade positioned for different uses.
Figure 10:
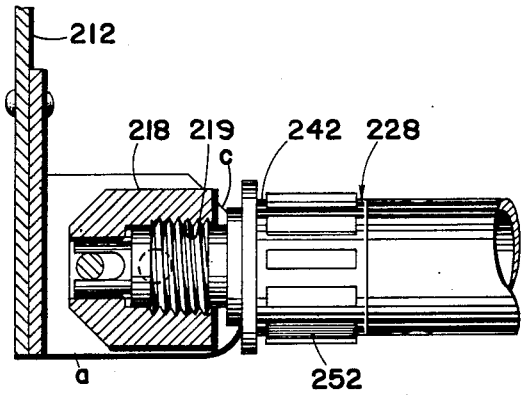
Figure 10:
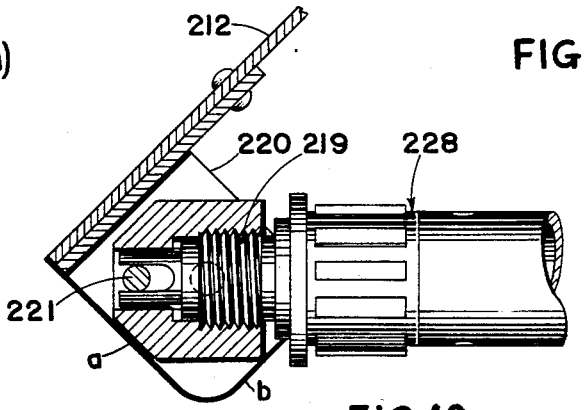
Figure 12:
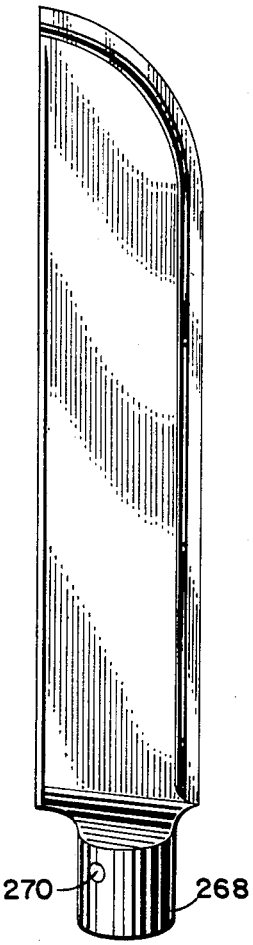
FIGS. 12, 13, 14, 15, 16, 17, 18, 19 and 20 illustrate a variety of tool device heads that may be conveniently connected to the elongated member component of this invention provided with the modified coupling connector, specifically, a bush knife, a limb saw, a pry bar or chisel, a cable eye, a pick, a tent grommet centering point, a hammerhead, a hand grip, wire cutting tool and conventional ax head, respectively.
Figure 13:
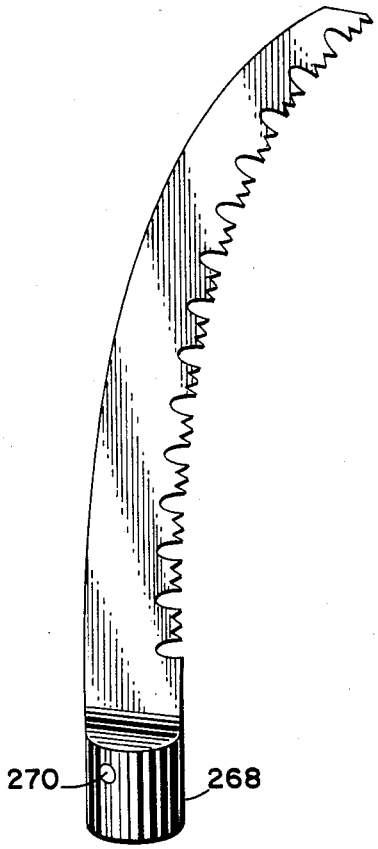
Figure 14:
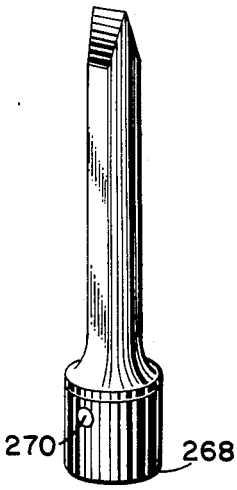
Figure 21:
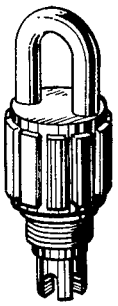
Figure 15:
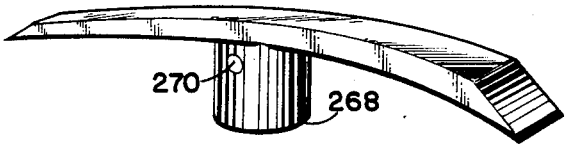
Figure 16:
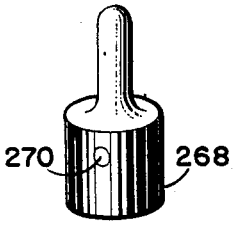
Figure 17:
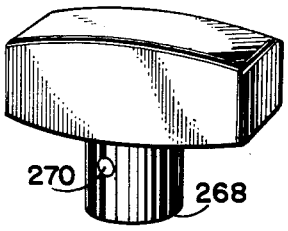

Referring now more particularly to FIGS. 1 through 20 of the drawings, a trenching spade designated generally by reference numeral 210 is another distinct form of the multi-purpose tool of my invention disclosed in my copending application Ser. No. 06/565,405 filed Dec. 27, 1983. It comprises a spade blade 212 also conventional in shape and also having at least one side thereof formed with a laterally extending protuberance or bulge 214, the edge of which is sharpened as at 216 to serve as an ax. I further provide spade blade 212 with a nail pull slot 215 in a side edge of the spade blade and a saw anchor key slot 217 in the body thereof. As more clearly shown in FIGS. 1 through 9, socket 218 having an internally threaded cavity 219 is pivotally connected to bracket 220 which is fixed to the rear edge of blade 212 by any convenient means such as, for example, rivets 222. Bracket 220 is formed with sides or edges which are angled relative to each other so that the seating surface of collar 246 of coupling member 228 shown in FIGS. 5 and 7 may be made to selectively bear against any of the angled edges of bracket 220 in order to positionally fix the angle of spade blade 212 as illustrated in FIGS. 10(*a*), (*b*) and (*c*). That is, with the blade 212 approximately parallel, at an approximate right angle to, and at an acute angle to the elongated handle 226. Also provided in cavity 219 is a diametrically disposed lock pin 221. As shown in FIG. 7, coupling member 228 is a male component comprising a central shaft 230 having a diametral hole 232 at one end thereof and at the other end is provided with slotted recesses 234 and 236 disposed at right angles of each other to form a yoked end 238. Shaft 230 is provided with a circumferential collar 240 adjacent the base of the yoked end. Rotatably mounted on shaft 230 is sleeve member 242. Shaft 230 is fitted in one tubular end of an elongated member 226 also referred to as pole ladder member 226 and an aligned hole 232 in the one end of shaft 230. An individual segment of pole ladder member 226 is used as a handle when combined with spade blade 212 or any of the tool head devices illustrated in FIGS. 11 through 20. Accordingly, when so used I will refer to the pole ladder member segment 226 as handle member 226.

Figure 3:
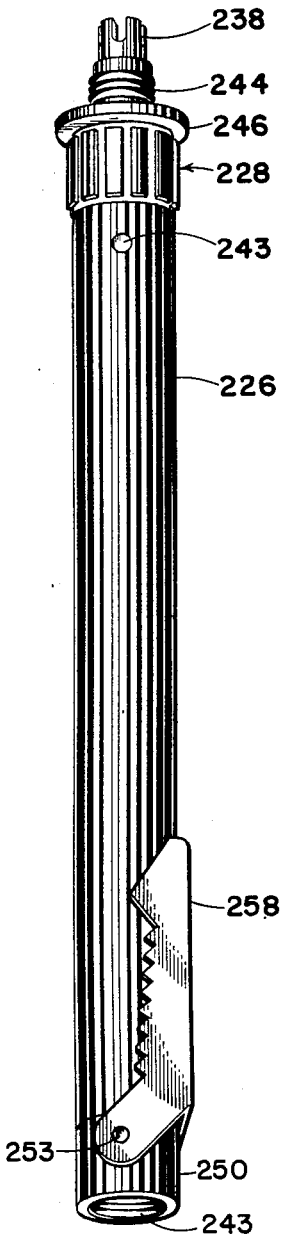
FIG. 3 is a perspective view of another tubular elongated member provided with modified connecting coupling members at the ends thereof.
Figure 8:
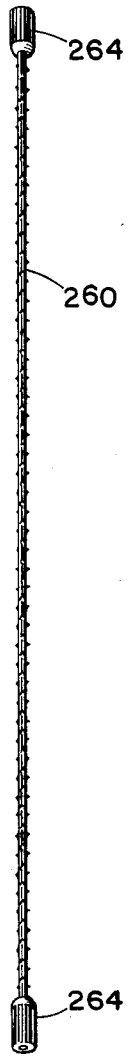
FIG. 8 is a perspective view of the saw blade showing its ends provided with anchor means.
Figure 4:
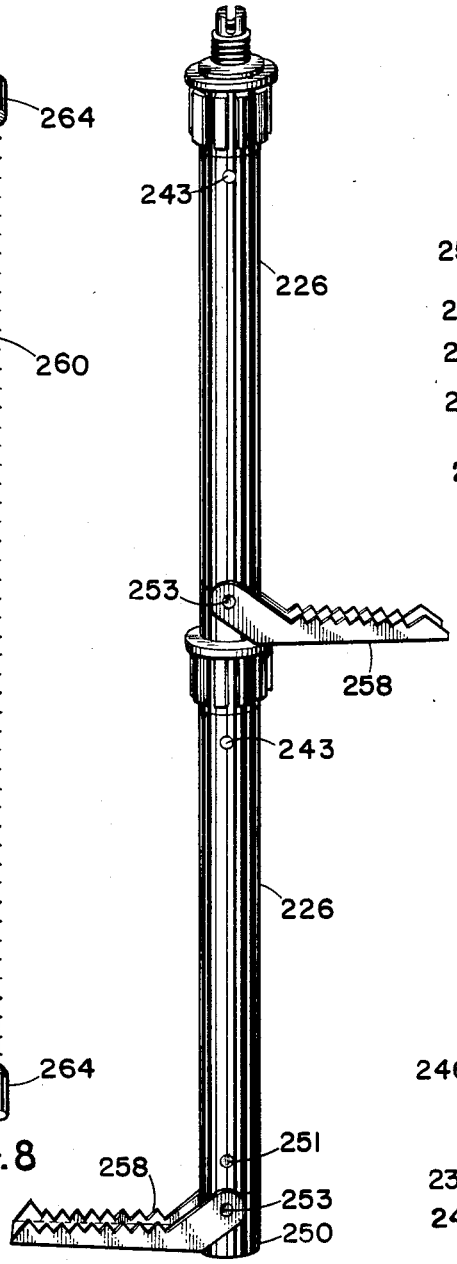
FIG. 4 is a perspective view of a pole ladder formed by combining a plurality of the modified tubular elongated members of FIG. 3.
Figure 6:
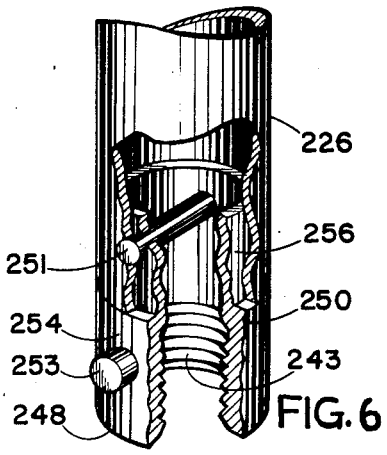
FIG. 6 is a perspective view of the female member of the connecting coupling showing parts broken away to more clearly show the connecting operation between the elongated members wherein the male member at one end of an elongated member is connected to the female member at the other end of another elongated member so that end to end connections may be made as shown in FIG. 4.
Figure 5:
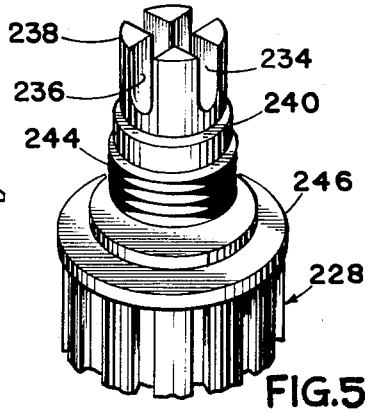
FIG. 5 is a perspective view of the male member of the connecting coupling.
Figure 1:
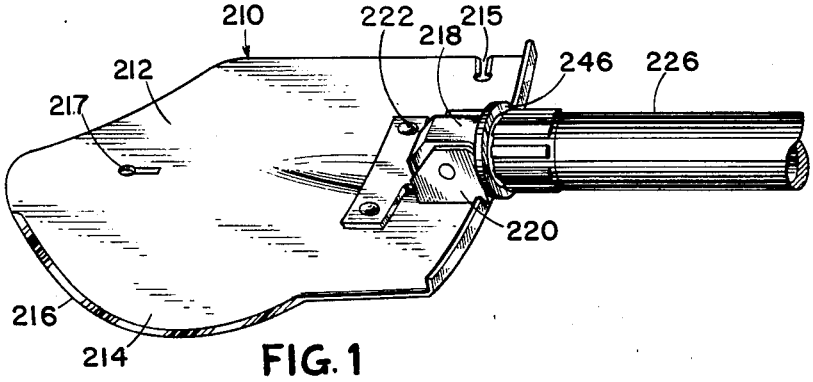
FIG. 1 is a perspective view of a modified spade blade of this invention provided with means enabling its use as a nail puller and further provided with means enabling its conversion to a modified type of saw as shown in FIG. 2.
Figure 2:
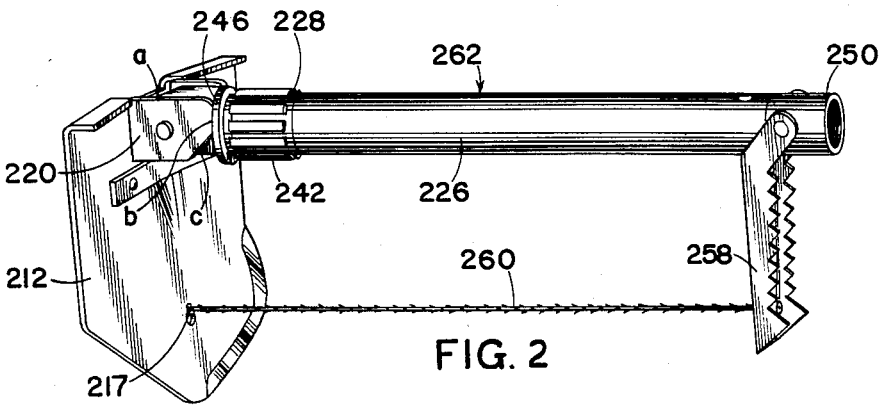
FIG. 2 is a perspective view of a modified saw.
Figure 11:
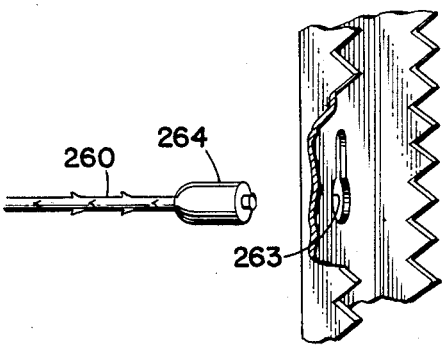
FIG. 11 is a perspective view of the ladder step element in fragment formed with key slot means to receive an anchor end of the saw blade to convert the spade component and the handle component to the saw of FIG. 2.
Figure 9:
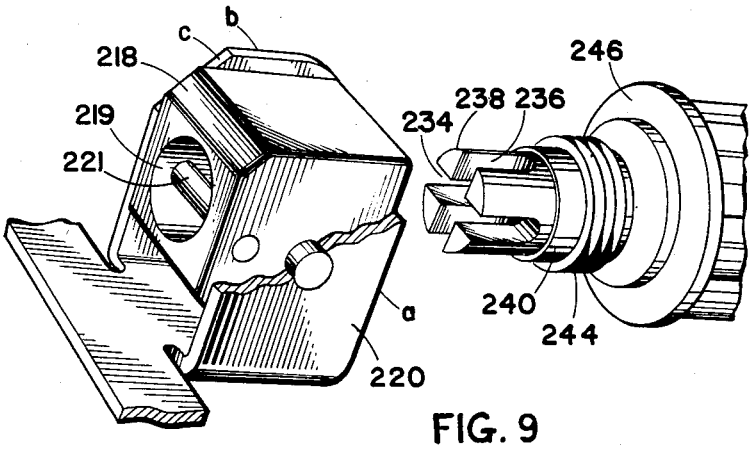
FIG. 9 is a perspective view of the spade connector shown in fragment and spaced therefrom is the male member in fragment of the connecting coupler in position to connect to the spade connector.

The longitudinal dimension of sleeve member 242 is approximately equal to the dimension between the end of handle member 226 and the proximate side of circumferential collar 240 adjacent the base of yoke end 238. The distal end of sleeve member 242 adjacent the proximate side of collar 240 of shaft 230 is provided with exterior threads 244. At the base of exterior threads 244 of sleeve member 242 stepped collar 246 is formed, a part thereof to serve as a seat to abut against the end 248 of female coupling member 250, and the radially extended part thereof to serve as a seat against sides (a), (b) or (c) of bracket 220. I further form the exterior circumferential surface of sleeve member 242 with spaced ridges 252 therearound to allow for a firm hand grip to rotate sleeve member 242. Provided on the other end of handle member 226 is female coupling member 250 structured to mate with male or yoked coupling member 228. Female coupling member 250 comprises a shouldered sleeve body 254. Part of the longitudinal length thereof having a reduced diameter as at 256 allowing it to be inserted into the cylindrical hollow of the other tubular end of handle member 226. The other longitudinal part of female coupling member 250 constituting the enlarged diameter is internally threaded as at 243 to receve threads 244 at the yoke end 238 of shaft 230 of coupling member 228. Female coupling member 250 is fixed in the other end of handle member 226 by means of pin 251 passing through holes provided in the other end of handle member 226 and the reduced diameter end of female coupling member 250. Accordingly, when coupling members 228 and 250 are coupled together by turning threaded end 244 of member 228 into member 250, the yoke end 238 of shaft 230 will engage diametral pin 251 passing through coupling member 250 and receive pin 251 in either of its slotted recesses 234 or 236, thereby preventing unwanted rotation of handle member 226 when connected to another elongated member 226 or to a tool head. Also provided on female coupling member 250 radially extending exterior therefrom are trunnion pins 253 on which step bars 258 are hinged saddle fashion as shown in FIGS. 3 and 4. The structure of female coupling member 250 and male coupling member 228 for securing one end of a handle member 226 to the other end of another handle member 226 to form a pole ladder combination as shown in FIG. 4 is clearly shown in FIGS. 3 through 7. The structure of male coupling member 228 fixed to one end of one pole ladder member 226 and the connection thereof to pivot socket 218 connected to the rear edge of spade blade 212 is clearly shown in FIGS. 1, 2, 9 through 10. As shown in FIGS. 1, 2 and 10, bracket 220 is provided with spaced sides or edges (a), (b) and (c) disposed at different angles relative to one another to provide positional surfaces against which the extended part of collar 246 of sleeve 242 may be made to bear against by rotating sleeve member 242 and thereby connecting threaded end 244 into threaded socket 218 or into female coupling member 25. By this simple and effective coupling means, on plurality of elongated members 226 may rigidly be fixed to spade blade 212 and spade blade 212 may be rigidly fixed to any of the positions shown in FIGS. 10 (*a*), (*b*) or (*c*). When spade blade 212 is fixed perpendicular to handle member 226, saw wire 260 may be combined with spade blade 212 and hinged step bar 258 to form a modified buck saw 262 as shown in FIG. 2. For this purpose step bar 258 is provided with a key slot 263 in the body thereof to receive and secure the enlarged anchor end 264 of saw wire 260. The enlarged anchor end 264 at the other end of saw wire 260 is secured in key hole slot 217 provided in the body of spade blade 212.

Figure 20:
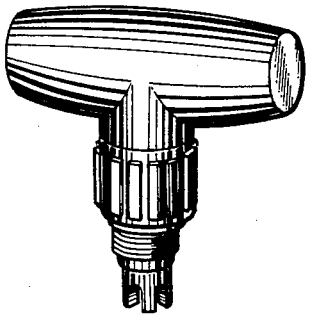
Figure 18:
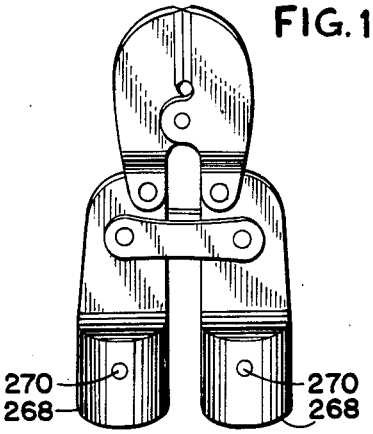
Figure 19:
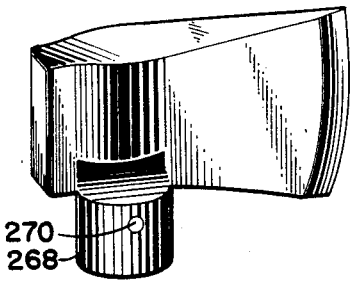

FIGS. 11 through 18 illustrate the type of different tool heads which may be attached to a handle member 226 provided with the coupling member 228. Each of these tool heads is formed with a tubular shank 268 into which is fitted and fixed therein by means of a lock pin 270, the female coupling member 250 illustrated in FIG. 6. Male coupling member 228 provided on one end of handle member 226 is threaded into female coupling member 250 thereby connecting handle member 226 to any of the tool heads of FIG. 11 through 18. The wire cutter head of FIG. 17 requires two separate handle members 226. FIGS. 19 and 20 illustrate that the tool head repesented can be provided with the male coupling member 228 which may be threadedly connected to the other end of handle member 226 which is provided with the female coupling member 250, especially is the opposite end of handle member 226 provided with male coupling member 228 is connected to another device such as spade blade 212.

It is obvious from the description of this embodiment of the invention, the spade blade and the hinged step bar 258 modified by providing slots 266 and 262, respectively, and the coupling members 228 and 250 provided at the ends of the elongated members 226 greatly augment the use of the camping tool of this invention.

I claim:

1. A connecting means for a plurality of pole components wherein each of said components being elongated members, and each end of each of said elongated members being longitudinally recessed to provide a cavity in the distal ends thereof, comprising:

a shaft having one end thereof secured in said cavity in one distal end of each of said plurality of elongated members, a major part of said shaft extending exterior of said cavity and longitudinally of said elongated member, the distal end of said shaft exterior of said cavity being slotted to provide circumferentially spaced longitudinal projections, and a circumferential collar provided adjacent the base of said projections;

a sleeve member rotatably mounted on said shaft, one end of said sleeve member abutting said one distal end of the elongated member and the other end of said sleeve member abutting the circumferential collar adjacent the base of said projections of said shaft, said other end of said sleeve member being threaded and provided with a circumferential collar adjacent said threaded end;

a pin diametrically fixed in the other distal end of each of said plurality of elongated members extending through said cavity; and a coupling sleeve having one end thereof secured in said cavity in the other distal end of each of said plurality of elongated members by said pin, the other end of said coupling sleeve being internally threaded to threadedly receive the threaded end of said sleeve member provided on another of said plurality of elongated members, said threaded connection positioning said pin connecting said coupling sleeve in said cavity in said slot of said shaft, and abutting said other end of said coupling sleeve to said collar of said sleeve member.

2. A pole component for a multi-purpose tool comprising:

an elongated member, each end of said elongated member being longitudinally recessed to provide a cavity in the distal ends thereof;

a shaft having one end thereof secured in said cavity in one distal end of said elongated member, a major part of said shaft extending exteriorly of said cavity and longitudinally of said elongated member, the distal end of said shaft exterior of said cavity being slotted to provide circumferentially spaced longitudinal projections, and a circumferential collar provided adjacent the base of said projections;

a sleeve member rotatably mounted on said shaft, one end of said sleeve member abutting said one distal end of the elongated member and the other end of said sleeve member abutting the circumferential collar adjacent the base of said projections of said shaft, said other end of said sleeve member being threaded and provided with a circumferential collar adjacent said threaded end;

a pin diametrically fixed in the other distal end of said elongated member extending through said cavity; and the other distal end of said elongated member being internally threaded.

3. A connecting means for a pole component wherein said component being an elongated member and each end of said elongated members being longitudinally recessed to provide a cavity in the distal ends thereof, comprising:

a shaft having one end thereof secured in said cavity in one distal end of said elongated member, a major part of said shaft extending exteriorly of said cavity and longitudinally of said elongated member, the distal end of said shaft exterior of said cavity being slotted to provide circumferentially spaced longitudinal projections, and a circumferential collar provided adjacent the base of said projections; and a sleeve member rotatably mounted on said shaft, one end of said sleeve member abutting said one distal end of the elongated member and the other end of said sleeve member abutting the circumferential collar adjacent the base of said projections of said shaft, said other end of said sleeve member being threaded and provided with a circumferential collar adjacent said threaded end.

4. A connecting means for a plurality of pole components wherein each of said pole components being elongated tubular members, each end of said elongated members being longitudinally recessed to provide a cavity in the distal ends thereof, comprising:

a shaft having one end thereof secured in said cavity in one distal end of each of said elongated members, a major part of said shaft extending exteriorly of said cavity and longitudinally of said elongated member, the distal end of said shaft exterior of said cavity being slotted to provide circumferentially spaced longitudinal projections, and a circumferential collar provided adjacent the base of said projections;

a sleeve member rotatably mounted on said shaft, one end of said sleeve member abutting said one distal end of said elongated member and the other end of said sleeve member abutting the circumferential collar adjacent said projections of said shaft, said other end of said sleeve member being threaded and provided with a circumferential collar adjacent said threaded end;

a pin diametrically fixed in the other distal end of each of said elongated members extending through said cavity; and a coupling sleeve having one end thereof secured by said pin in said cavity in said other distal end of each of said elongated members, the other end of said coupling sleeve being internally threaded.

5. The plurality of pole components of claim 4 wherein said threaded end of said sleeve member of one of said elongated members is further characterized as being threadedly connected to the internally threaded end of said coupling sleeve of another of said elongated members.

6. A plurality of pole components of a multi-purpose tool comprising:

a plurality of elongated members;

each end of each of said elongated members being longitudinally recessed to provide a cavity in the distal ends thereof;

a shaft having one end thereof secured in said cavity in one distal end of each of said plurality of elongated members, a major part of said shaft extending exteriorly of said cavity and longitudinally of said elongated member, the distal end of said shaft exterior of said cavity being slotted to provide circumferentially spaced longitudinal projections, and a circumferential collar provided adjacent the base of said projections;

a sleeve member rotatably mounted on said shaft, one end of said sleeve member abutting said one distal end of the elongated member and the other end of said sleeve member abutting the circumferential collar adjacent the base of said projections of said shaft, said other end of said sleeve member being threaded, and provided with a circumferential collar adjacent said threaded end;

a pin diametrically fixed in the other distal end of each of said plurality of elongated members extending through said cavity; and a coupling sleeve having one end thereof secured in said cavity in the other distal end of each of said plurality of elongated members by said pin, the other end of said coupling sleeve being internally threaded to threadedly receive the threaded end of said sleeve member provided on another of said plurality of elongated members, said threaded connection positioning said pin connecting said coupling sleeve in said cavity in said slot of said shaft, and abutting said other end of said coupling sleeve to said collar of said sleeve member.

7. The plurality of pole components of claim 6 wherein said elongated members are further characterized as having a bar member pivotally connected to the other end of each of said elongated members.

8. A tool device for use with a handle member of the type which comprises an elongated member, one end of which elongated member is longitudinally recessed to provide a cavity in one distal end thereof;

a shaft having one end thereof secured in said cavity, in said one distal end of said elongated member, a major part of said shaft extending exteriorly of said cavity and longitudinally of said elongated member, the distal end of said shaft exterior of said cavity being slotted to provide circumferentially spaced longitudinal projections; and a sleeve member rotatably mounted on said shaft, one end of said sleeve member abutting said one distal end of the elongated member and the other end of said sleeve member being positioned adjacent the base of said projections of said shaft, said other end of said sleeve member being threaded, comprising:

a tool body;

a tubular shank member extending from said tool body, said tubular shank member having internal threads sized and shaped to receive the threaded end of said sleeve member; and a pin permanently fixed in said tubular shank member extending diametrically through the cavity thereof, said pin being sized and positioned to be received between said longitudinal projections of said shaft when said threads of said sleeve member are threaded into said tubular shank member.

9. The tool device of claim 8 wherein said tool body is further characterized as being a knife blade.

10. The tool device of claim 8 wherein said tool body is further characterized as being a limb saw.

11. The tool device of claim 8 wherein said tool body is further characterized as being a pry bar.

12. The tool device of claim 8 wherein said tool body is further characterized as being a pick.

13. The tool device of claim 8 wherein said tool body is further characterized as being a spike.

14. The tool device of claim 8 wherein said tool body is further characterized as being a hammer head.

15. The tool device of claim 8 wherein said tool body is further characterized as being an ax head.

16. The tool device of claim 8 wherein said tool body is further characterized as being a wire cutter.

17. A tool device comprising:

a tool body;

a tubular shank member extending from said tool body;

a shaft having one end thereof secured in said tubular shank member, a major part of said shaft extending exteriorly of said tubular shank member, the distal end of said shaft exterior of said tubular shank member being slotted to provide circumferentially spaced longitudinal projections, and a circumferential collar being provided adjacent the base of said projections.

18. The tool device of claim 17 wherein said tool body is further characterized as being a tee handle.

19. The tool device of claim 17 wherein said tool body is further characterized as being an eye bolt.

20. A combination tool, comprising:

a tool device unit for attachment to an elongated handle comprising an earth digging spade blade having a forward digging edge and a rearward spaced edge and a bracket near the rearward edge which has a plurality of seating surfaces formed thereon, which seating surfaces are formed so as to be alternately seated against a coupling member of a handle when the surface of said blade is oriented parallel to a handle or oriented at an acute angle thereto;

a first coupling unit pivotably mounted to said bracket so as to be pivotable to align with a handle therewith, so as to allow different ones of said seating surfaces to be seated against the handle;

an elongated handle, said handle also having a seating surface for receiving the seating surface of said bracket;

one of said coupling units defining a cavity for receiving a male member and threading for threadably receiving a threaded sleeve, and the other of said coupling units having a male projection for entering the cavity of said one coupling unit in a non-rotatable fit, and a rotatably mounted sleeve thereon which has threading for mating with said one coupling unit; and whereby said blade may be releasably but securely affixed to the handle with the blade in any selected one of said orientations.

* * * * *

UNITED STATES PATENT OFFICE

CERTIFICATE OF CORRECTION

Patent No. 4,700,420 Dated October 20, 1987

Inventor(s) John Belanger

It is certified that error appears in the above-identified patent and that said Letters Patent are hereby corrected as shown below:

Column 3 - Line 35: delete "receve" and substitute --receive--

Column 4 - Line 1: delete "on" and substitute --one--

Column 4 - Line 30: delete "is" and substitute --if--

Column 6 - Line 61: delete "pivotally" and substitute --pivotably--

Signed and Sealed this

Thirtieth Day of August, 1988

*Attest:*

DONALD J. QUIGG

*Attesting Officer*

*Commissioner of Patents and Trademarks*